US008616731B2

(12) United States Patent
Quadri et al.

(10) Patent No.: US 8,616,731 B2
(45) Date of Patent: Dec. 31, 2013

(54) STAGE LIGHT FIXTURE AND LIGHT FIXTURE ASSEMBLY COMPRISING SAID STAGE LIGHT FIXTURE

(75) Inventors: Pasquale Quadri, Torre De' Roveri (IT); Angelo Cavenati, Brusaporto (IT)

(73) Assignee: Clay Paky S.p.A., Seriate (IT)

( * ) Notice: Subject to any disclaimer, the term of this patent is extended or adjusted under 35 U.S.C. 154(b) by 859 days.

(21) Appl. No.: 12/638,712

(22) Filed: Dec. 15, 2009

(65) Prior Publication Data

US 2010/0157604 A1 Jun. 24, 2010

(30) Foreign Application Priority Data

Dec. 16, 2008 (IT) ..... MI2008A2234

(51) Int. Cl.
*F21V 9/00* (2006.01)

(52) U.S. Cl.
USPC ..... 362/293; 362/398; 362/282

(58) Field of Classification Search
USPC ..... 362/398, 293, 282
See application file for complete search history.

(56) References Cited

U.S. PATENT DOCUMENTS

| | | | | |
|---|---|---|---|---|
| 4,823,245 | A * | 4/1989 | Leverte | 362/293 |
| 5,371,663 | A * | 12/1994 | Chuang | 362/280 |
| 8,157,407 | B2 * | 4/2012 | Palmer et al. | 362/197 |
| 2008/0137345 | A1 | 6/2008 | Wimberly | |
| 2008/0151542 | A1 * | 6/2008 | Liddle | 362/240 |
| 2009/0142724 | A1 * | 6/2009 | Rosenblood et al. | 433/29 |

FOREIGN PATENT DOCUMENTS

| | | | |
|---|---|---|---|
| FR | 2754041 | A | 4/1998 |
| GB | 862733 | A | 3/1961 |
| WO | 95/06273 | A | 3/1995 |
| WO | 98/10220 | A | 3/1998 |

OTHER PUBLICATIONS

Italian Search Report dated Jun. 26, 2009 as issued in Italian Application No. IT MI2008A 002234 filed on Dec. 16, 2008.

* cited by examiner

*Primary Examiner* — Joseph L Williams
(74) *Attorney, Agent, or Firm* — Dorsey & Whitney LLP

(57) ABSTRACT

A stage light fixture is provided with a main body extending along a longitudinal axis and having an outer surface; a light source arranged inside the main body at a first end of the main body and suitable to emit a light beam substantially along the axis; and with an objective lens arranged at a second end of the main body; the main body is provided with a plurality of inserts to fix to the outer surface, by means of a magnetic coupling, a filter suitable to intercept the light beam which crosses the objective lens; the inserts are made of a magnetic material and/or of a metallic material suitable to be attracted by a magnetic material.

8 Claims, 3 Drawing Sheets

STAGE LIGHT FIXTURE AND LIGHT FIXTURE ASSEMBLY COMPRISING SAID STAGE LIGHT FIXTURE

The present invention relates to a stage light fixture and to a light fixture assembly comprising said stage light fixture.

BACKGROUND OF THE INVENTION

A stage light fixture of the known type comprises a main body extending along a longitudinal axis, a light source arranged inside the main body at a first end of the main body and suitable to emit a light beam substantially along the axis, and an objective lens arranged at a second end of the main body.

In the show business field, stage light fixtures are often used in combination with outer filters adapted to color the light beam which crosses the objective lens of the light fixture. These outer filters are substantially colored sheets, generally made of plastic, and are often preferred to the colored filters arranged inside the light fixture because of their particular properties. Indeed, in outer filters, the color is distributed in a more uniform manner than in inner filters, and furthermore the available color range for outer filters is much broader than the range of colors made available for inner filters.

However, these outer filters are fixed to the stage light by generally not very reliable fastening means. Indeed, the filter sometimes detaches from the light fixture during fast movements imparted to the light fixture for stage purposes.

The most used fastening means in this field is common adhesive tape, which does not always ensure a firm fastening and furthermore requires rather long application times.

SUMMARY OF THE INVENTION

It is an object of the present invention to provide a stage light fixture which is free from the drawbacks of the prior art illustrated herein; in particular, it is an object of the invention to provide a stage light fixture to which the outer filters available on the market may be simply, rapidly and reliably fixed.

In accordance with these objects, the present invention relates to a stage light fixture comprising a main body extending along a longitudinal axis and provided with an outer surface; a light source arranged inside the main body at a first end of the main body and suitable to emit a light beam substantially along the axis; and an objective lens arranged at a second end of the main body; the light fixture being characterized in that the main body comprises a plurality of inserts to fix to the outer surface, by means of a magnetic coupling, a filter suitable to intercept the light beam which crosses the objective lens; the inserts being made of a magnetic material and/or of a metallic material suitable to be attracted by a magnetic material.

It is a further object of the invention to provide a simple, reliable light fixture assembly.

In accordance with these objects, the present invention relates to a light fixture assembly comprising a light fixture as claimed in the attached claims, a filter and magnetic coupling means to fix the filter to the outer surface of the main body so that the filter intercepts the light beam which crosses the objective lens.

BRIEF DESCRIPTION OF THE DRAWINGS

Further features and advantages of the present invention will be apparent from the following description of a non-limiting embodiment thereof, with reference to the figures in the accompanying drawings, in which.

DETAILED DESCRIPTION OF THE INVENTION

Figure 1:
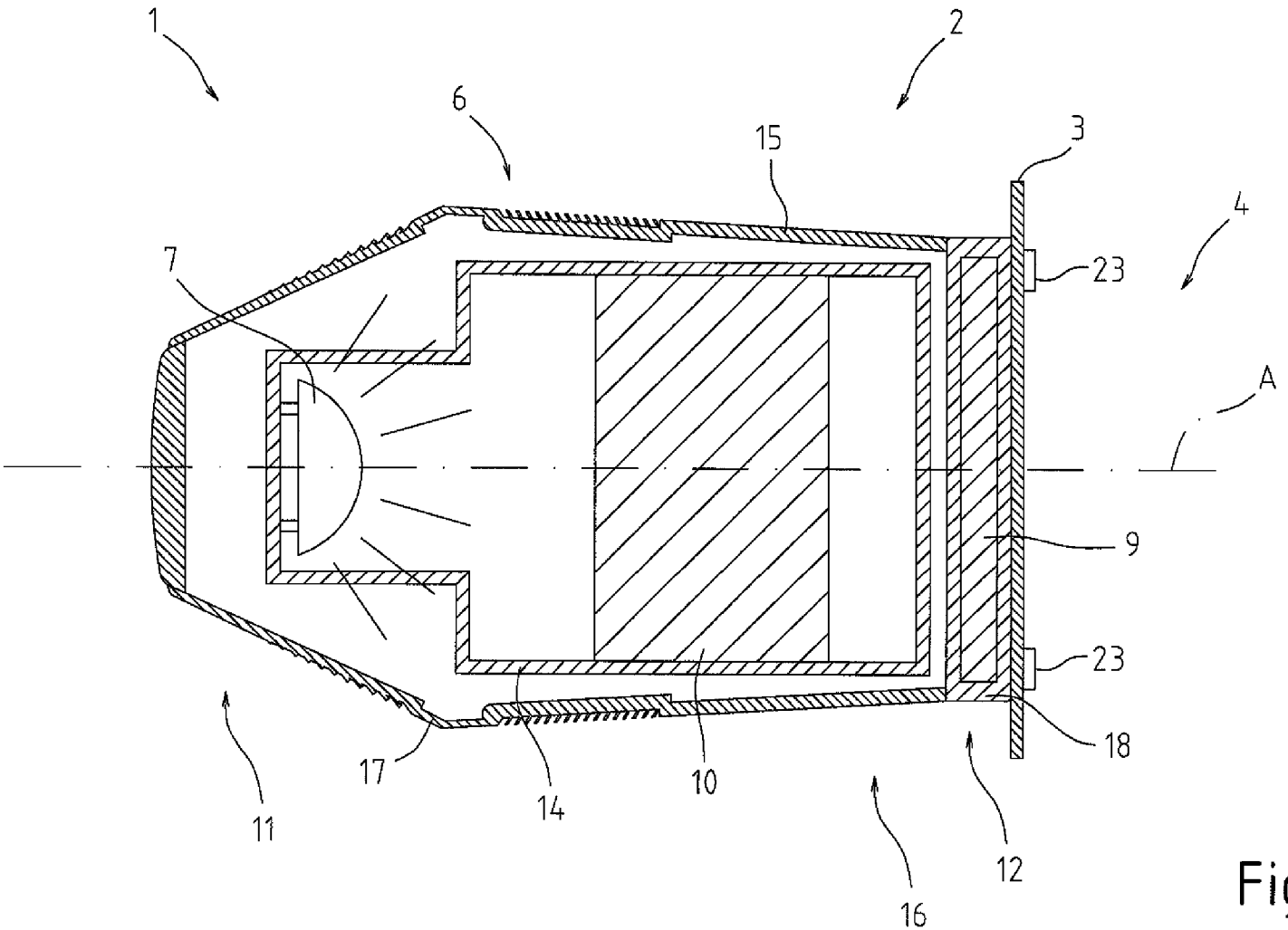
FIG. 1 is a diagrammatic section view, with parts removed for clarity, of a light fixture assembly made according to the present invention.

In FIG. 1, numeral 1 indicates a light fixture assembly comprising a stage light fixture 2, an outer filter 3 and magnetic coupling means 4.

The light fixture 2 comprises a main body 6 being elongated in shape and extending along a longitudinal axis A, a light source 7 suitable to emit a light beam substantially along the axis A, an objective lens 9, and optical assemblies 10 for adjusting the light beam (diagrammatically shown in the figure as a single element).

The main body 6 has a first end 11 and a second end 12 opposite to the first end 11 along the axis A and comprises an inner frame 14 and an outer shell 15.

The inner frame 14 supports the light source 7 at the first end 11 and supports the optical assemblies 10 so that the optical assemblies 10 are arranged between the light source 7 and the objective lens 9 to intercept the light beam.

The outer shell 15 defines an outer surface 16 (best seen in FIG. 2) and comprises a base 17 and a flange 18.

Base 17 is suitable to contain the inner frame 14, the light source 7 and the optical assemblies 10.

Flange 18 may be coupled to the base 17, e.g. by means of screws, and is suitable to support the objective lens 9 at the second end 12, so that the objective lens 9 is substantially centered on the axis A.

Figure 2:
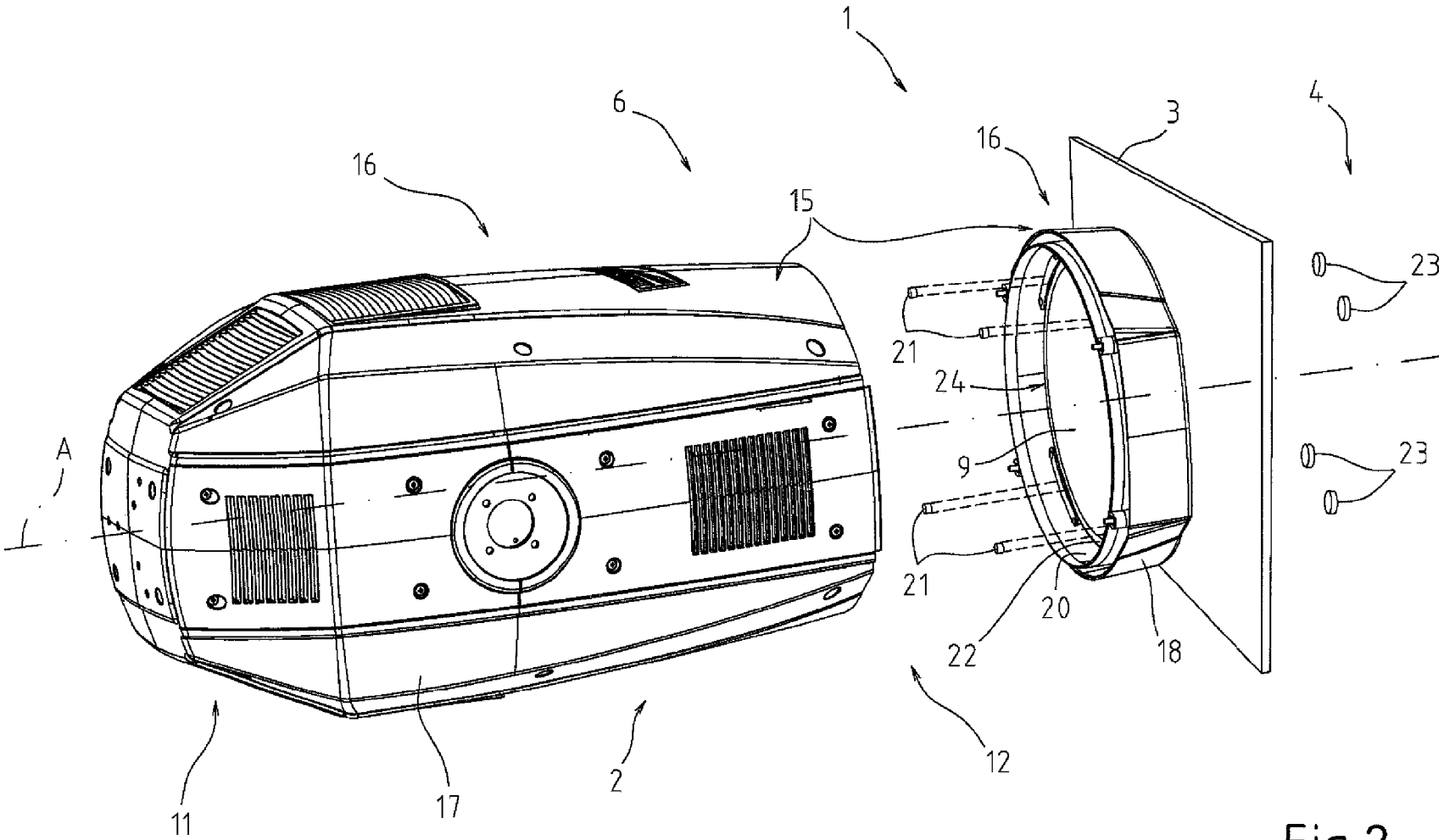
FIG. 2 is an exploded perspective view, with parts removed for clarity, of the light fixture assembly in FIG. 1.
Figure 3:
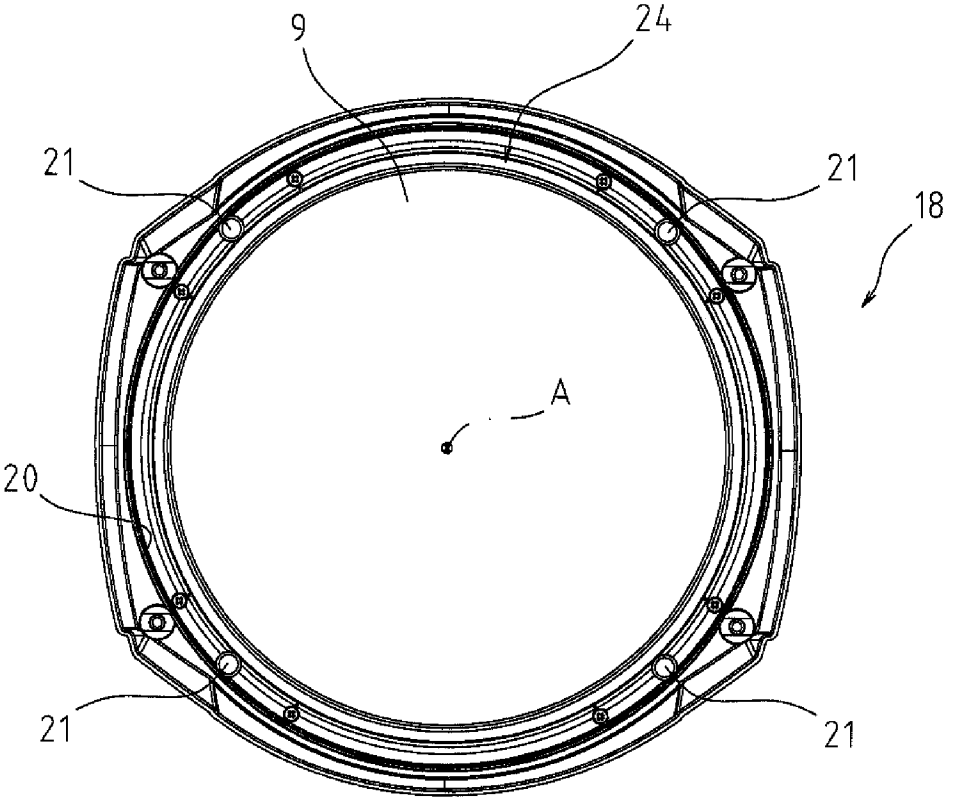
FIG. 3 is a rear view, with parts removed for clarity, of a detail of the light fixture assembly in FIG. 1.

With reference to FIGS. 2 and 3, flange 18 comprises an inner ring 20 suitable to support the objective lens 9 and a plurality of inserts 21.

The inner ring 20 substantially extends about the axis A and is provided with an annular edge 22 substantially orthogonal to the axis A, which defines an inner annular face 24 suitable to face in use the base 17, and an outer annular face (not shown in the accompanying drawings) suitable to be arranged, in use, in contact with filter 3.

The inserts 21 are fixed to the inner annular face 24 and are substantially arranged equally spaced from one another along the inner annular face 24.

In the non-limiting example described and illustrated herein, there are four inserts 21 fixed by means of adhesive to the inner annular face 24.

Points are preferably marked on the outer annular face, at which the inserts 21 are arranged to facilitate the operations for fixing filter 3, in use.

The inserts 21 are made of magnetic material or metallic material suitable to be attracted by a magnetic material.

The term "magnetic material" means hereinafter a material capable of generating a magnetic field.

In the non-limiting example described and illustrated herein, the inserts are cylinders made of magnetic material.

With reference to FIGS. 1 and 2, filter 3 is a filter suitable to color the light beam which crosses it.

In the non-limiting example described and illustrated herein, the filter 3 is a colored sheet made of plastic material, e.g. a polymeric gel.

In use, filter 3 is suitable to be coupled to the outer surface 16 of the outer shell 15 by means of magnetic coupling means 4 so as to intercept the light beam which crosses the objective lens 9. In particular, filter 3 is suitable to be coupled with the flange 18 of the outer shell 15.

The magnetic coupling means 4 comprise a plurality of coupling elements 23, each of which is suitable to magnetically interact with a respective insert 21. Indeed, the coupling elements 23 are made of a material attracted by the material of which the inserts 21 are made.

In particular, the coupling elements 23 are made of magnetic material attracted by the magnetic material of the respective inserts 21 or of a metallic material attracted by the magnetic material of the respective inserts 21 when the inserts 21 are made of magnetic material; otherwise, the coupling elements 23 are made of magnetic material which attracts the metallic material of the respective inserts 21 when the inserts 21 are made of metallic material.

In the non-limiting example described and illustrated herein, the coupling elements 23 are plates made of magnetic material attracted by the magnetic material of which the inserts 21 are made. In a variant of the present invention, the coupling elements 23 are plates made of metallic material attracted by the magnetic material of which the inserts 21 are made, e.g. a material having a magnetic permeability, such as iron.

Filter 3 is fixed by arranging the filter 3 substantially in contact with the outer annular face of the flange 18 and approaching the coupling elements 23 to the flange 18 at the marked points on the outer annular face of flange 18, until the magnetic attraction action between the coupling elements 23 and the respective inserts 21 does not occur.

The presence of the inserts 21 advantageously allows to rapidly couple filter 3 to the light fixture 2 and ensures that such a coupling is firm even when moving the light fixture 2.

Moreover, the presence of the inserts 21 allows to possibly replace the filter 3 in a simple, rapid manner, with evident advantages from the stage design point of view.

It is finally apparent that changes and variations may be made to the stage light fixture 2 and to the light fixture assembly 1 described herein, without departing from the scope of the appended claims.

The invention claimed is:

1. A stage light fixture comprising:

a main body extending along a longitudinal axis and including an outer surface, a first end, and a second end generally opposite the first end;

a light source arranged inside the main body toward the first end of the main body, the light source being configured to emit a light beam substantially along the longitudinal axis;

an objective lens arranged toward the second end of the main body;

a filter configured to intercept the light beam crossing the objective lens; and a plurality of inserts configured to selectively and magnetically affix the filter to the outer surface of the main body exclusively and only by the plurality of inserts, and wherein the inserts are made of a magnetic material and/or of a metallic material suitable to be attracted by a magnetic material.

2. The stage light fixture according to claim 1, wherein the main body comprises an outer shell, which extends along the longitudinal axis and comprises the outer surface, and an inner frame suitable to support the light source; the outer shell comprising the inserts.

3. The stage light fixture according to claim 2, wherein the outer shell comprises a base, suitable to contain the inner frame and the light source, and a flange, suitable to be coupled to the base and to support the objective lens; the flange comprising the inserts.

4. The stage light fixture according to claim 3, wherein the flange comprises an inner ring suitable to support the objective lens, which is provided with an inner annular face facing the base and an outer annular face; the inserts being fixed to the flange along the inner annular face.

5. The stage light fixture according to claim 4, wherein the inserts are arranged equally spaced one another along the inner annular face of the flange.

6. A stage light fixture comprising:

a main body extending along a longitudinal axis, the main body including a base and a flange having an outer annular face;

a light source positioned inside the main body near the base, the light source configured to emit a light beam substantially along the longitudinal axis;

an objective lens near the outer annular face;

a filter positionable in direct contact with the outer annular face, the filter configured to intercept the light beam crossing the objective lens; and a plurality of inserts configured to magnetically affix the filter to the outer annular face exclusively and only by the plurality of inserts, the inserts comprising a magnetic material and/or a metallic material suitable to be attracted by a magnetic material.

7. The stage light fixture of claim 6, wherein the flange comprises an inner ring suitable to support the objective lens, the inner ring including an inner annular face facing the base, wherein the inserts are fixed along the inner annular face.

8. The stage light fixture of claim 7, wherein the inserts are equally spaced from each other along the inner annular face of the flange.

* * * * *